United States Patent [19]

Hoshino

[11] Patent Number: 4,533,335

[45] Date of Patent: Aug. 6, 1985

[54] COLD-PROOF WATER-PROOF GARMENT

[75] Inventor: Takahiro Hoshino, Yokohama, Japan

[73] Assignee: Toyo Bussan Kabushiki Kaisha, Tokyo, Japan

[21] Appl. No.: 472,021

[22] Filed: Mar. 4, 1983

[51] Int. Cl.[3] ..... B63C 9/16

[52] U.S. Cl. ..... 441/102; 441/104; 441/123; 441/124

[58] Field of Search ..... 441/88, 102–105, 441/123, 124, 92, 117; 2/2.1 R, 82, DIG. 3

[56] References Cited

U.S. PATENT DOCUMENTS

| | | | |
|---|---|---|---|
| 1,909,180 | 5/1933 | Jackson | 441/103 |
| 2,321,583 | 6/1943 | Craig et al. | 441/106 |
| 2,607,934 | 8/1952 | Bailhe | 441/107 |
| 2,618,257 | 11/1952 | Berkman | 441/104 |
| 2,911,649 | 11/1959 | Ruelle et al. | 441/107 |
| 3,345,657 | 10/1967 | Peeler et al. | 441/92 |
| 3,369,263 | 2/1968 | Kreckl | 441/104 |
| 3,403,406 | 10/1968 | Weissberg | 441/124 |
| 4,023,223 | 5/1977 | Anderson et al. | 441/104 |

FOREIGN PATENT DOCUMENTS

| | | | |
|---|---|---|---|
| 1250955 | 12/1960 | France | 441/104 |

*Primary Examiner*—Galen L. Barefoot
*Assistant Examiner*—Stephen P. Avila
*Attorney, Agent, or Firm*—L. Lawton Rogers, III

[57] ABSTRACT

There is disclosed a cold-proof water-proof garment, which is to be worn for marine operations on cold water and can save life in such a case as when a man wearing it accidentally drops into water or encounters perils of the sea.

10 Claims, 14 Drawing Figures

PRIOR ART

PRIOR ART

COLD-PROOF WATER-PROOF GARMENT

BACKGROUND OF THE INVENTION

In fishing operations and other marine operations in cold seas such as northern waters in the coldest season, it is desired for the workers to wear a cold-proof water-proof garment for coping with the coldness and saving life in case of a possible marine accident.

The prior art cold-proof water-proof garment is formed by uniting portions corresponding to a coat, pants, gloves and boots and also providing a separate or united hood, providing the whole dress with water-proof and heat insulating functions and providing at least the coat portion with a buoyancy sufficient to allow the man who wears it to float on the water surface. Further, the front section of its coat portion is provided with a water-tight fastener so that it can be worn and taken off by opening the fastener. The hood is formed with a front opening, the edge of which is made of a flexible material to prevent entry of water into the inside of the garment through the opening. This garment, however, has problems in the movability or ability of the man who wears it to do work and also in the posture, in which he or she floats on the water surface.

To be more specific, the cold-proof water-proof garment is designed such that the man who wears it will never die from drowning or perish in a short period of time when he or she falls into water provided it is worn perfectly. Actually, however, if the man who wears the prior art cold-proof water-proof garment mentioned above even perfectly is thrown into the sea in the event of an accident or the like, he or she flaots on the water surface nearly in a horizontal posture. If he or she floats with his or her front down in a trance, his or her face if submerged in the water so that he or she is suffocated. Even if he or she is not in a trance, he or she floats on the water surface very instably for rescue because he or she floats nearly horizontally so that the head, which is heavy in weight, tends to be inclined downwards.

Further, in fishing operations on the sea, the worker sweats a great deal because of very intense physical efforts paid for the work even in the coldest season and also irrespective of whether he or she is wearing the cold-proof water-proof garment or not. For this reason, the worker usually wears the cold-proof water-proof garment in a loose or relaxed state around the neck loosened with an upper portion of the fastener opened when he or she is in the work. If the worker wearing the garment in this state falls into the sea, however, cold sea water will enter the garment through the open upper portion of the fastener so that the garment will no longer serve its role.

The worker also wears the cold-proof water-proof garment with the fastener thereof opened when he or she does the work because of water-tight structures provided on the portions of the garment around the neck and wrists. To be more specific, when the cold-proof water-proof garment is perfectly worn, its portions corresponding to the neck and wrists are in close contact with the neck and wrists in a suitably shrunk or bound state. The fastener is often opened for obtaining a relief from the strong binding of the neck by the corresponding portion of the garment.

SUMMARY OF THE INVENTION

The invention is intended in the light of the difficiencies discussed above inherent in the prior art cold-proof water-proof garment.

An object of the invention is to provide a cold-proof water-proof garment, which normally does not strongly bind the neck when it is worn for works and permits a water-tight structure to be obtained around the neck when such a water-tight structure becomes necessary such as when one wearing it falls into the sea.

Another object of the invention is to provide a cold-proof water-proof garment, with which the buoyancy of its coat portion centered on the neck part thereof can be increased so that when a man wearing it comes to be floated with his or her front down on the water surface, he or she will be reliably turned back or inverted to a state with his or her front up.

DETAILED DESCRIPTION OF PREFERRED EMBODIMENTS

Figure 1:
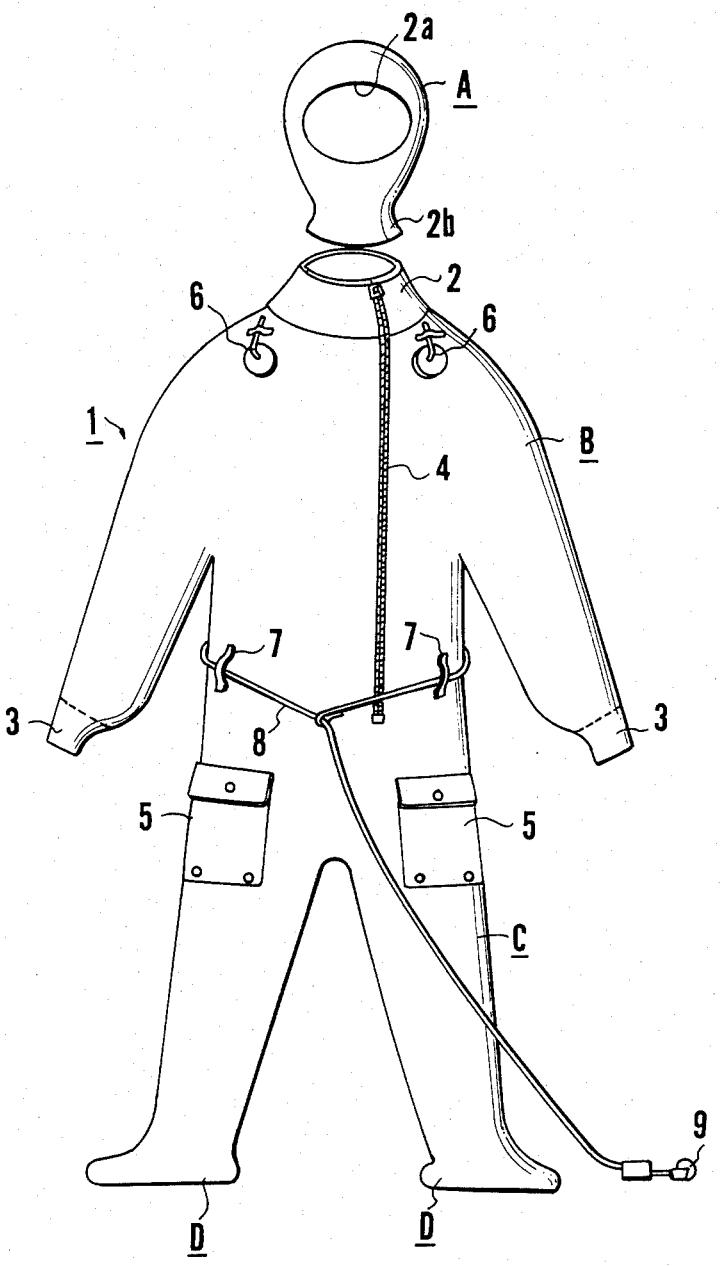
FIG. 1 is an elevational view showing a prior art example of the cold-proof water-proof garment having a separate hood.

FIG. 1 shows, in an elevational view, the outer cloth 1 of a prior art example of the cold-proof water-proof garment having a coat portion B, a pants portion C and a boots portion D, these portions being united together, and also having a separate hood A. The outer cloth 1 is made from a water-proof rubber sheet. The neckband 2 and the wristbands 3 of the coat portion B are made of a foamed rubber or synthetic rubber having satisfactory water-proof and shrinkage properties. The coat portion B is provided with a water-tight fastener 4 extending from the neckband 2 to the lower end of its front section. The pants portion C is provided with outer pockets 5. The front section of the coat portion B is provided near shoulder portions with air discharge tubes having respective inner check valves (not shown) for discharging air inside the outer cloth 1. The outer cloth 1 is further provided with a lift rope guide members 7 around its waist portion. A life rope having a hook ring provided at one end is retained by the guide members 7.

The material of the outer cloth 1 itself does not provide a buoyancy sufficient to support a man on the water surface. When the garment is perfectly worn, however, substantially no water can enter the inside of the outer cloth 1. In this state, air retained between the outer cloth 1 and an inner suit or other underwears, constitutes a temperature insulation layer and also a buoyancy-providing layer. On the inner side of the outer cloth 1, an inner suit (not shown) is accordingly provided, which is formed mainly from a material having a temperature insulating property, for instance a soft foamed sheet. The hood A of this cold-proof water-proof garment has an opening 2*a* and a neck portion 2*b*.

When the outer cloth 1 of the above prior art cold-proof water-proof garment is worn over the inner suit thereof and its fastener is perfectly closed, water cannot readily enter the inside of the outer clock 1 through the neckband and wristbands for the neckband and wristbands are in close contact with the body of the man who wears the garment. Also, air trapped between the outer cloth 1 and the inner suit and/or other underwears has a temperature insulating effect and also provides a buoyancy. Thus, when the man wearing the garment in the perfect state falls into the sea, water will never readily enter in a large quantity into the inside of the outer cloth 1, that is, the cold-proof water-proof garment can properly serve its role. Actually, however, the man wearing the garment floats on the water surface in a substantially horizontal, dangerous posture. Also, if the man wearing the garment with the fastener 4 opened in the neighborhood of the neckband falls into the sea, the cold-proof water-proof garment can no longer serve properly its role.

Figure 3:
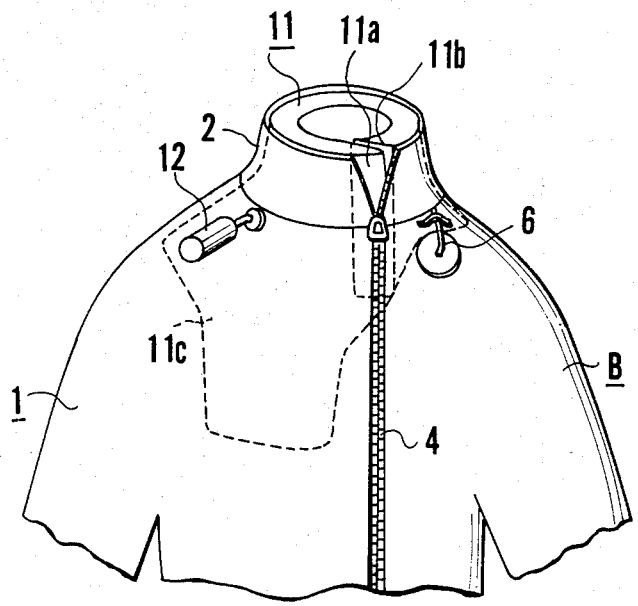
FIG. 3 is a gragmentary elevational view showing an embodiment of the cold-proof water-proof garment having a separate hood according to the invention.
Figure 4:
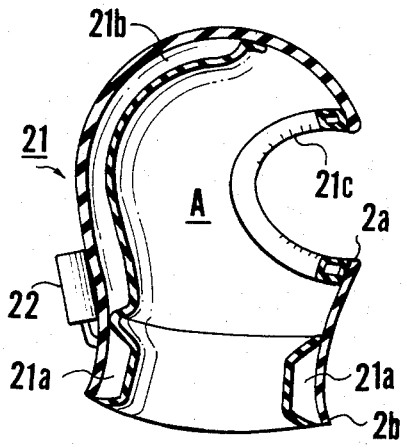
FIG. 4 is a side-wise sectional view showing the same separate hood of the embodiment.

FIGS. 3 and 4 show an embodiment of the cold-proof water-proof garment according to the invention. In the Figures, like parts as those in FIG. 1 are designated by like reference symbols.

Referring to these Figures, reference numeral 11 designates an inflatable air chamber, which is made from a soft sheet and is tied to the inner side of the outer cloth 1. In this embodiment, the inflatable air chamber 11 is provided over the entire neckband and mainly a right side part of the front section covering the shoulder and part of the breast. It has portions 11*a* and 11*b* which project from the mate members of the fastener 4 of the outer coat 4 in an upper portion of the fastener. When an upper portion of the fastener 4 is open, the open space is closed by the portions 11*a* and 11*b* in an overlapping state. A right side breast portion 11*c* of the inflatable air chamber 11 has a sufficiently large size. Reference numeral 12 designates an air source, e.g. an air bomb, for supplying air to the inflatable air chamber 11. The air source 12 is either manually or automatically operable to supply air to the inflatable air chamber 11. Where the portions 11*a* to 11*c* of the inflatable air chamber 11 are independently formed, an air source is provided for each of these portions. Further, it is possible to arrange such that a man who is wearing the cold-proof water-proof garment may supply the inhaled air to the inflatable air chamber 11.

Normally, the inflatable air chamber 11 is not filled with air. Thus, it is not obstructive when taking on the garment. Also, when the garment is worn in a loose or relaxed state with the fastener 4 imperfectly closed, the inflatable air chamber 11 is never obstructive since the chamber 11 is not inflated.

In the event when a man who is wearing the garment in a relaxed state, i.e., with the fastener 4 closed imperfectly, has fallen into the sea during his or her work, he or she can supply air to the inflatable air chamber 11 by opening the air bomb 12. By so doing, the open portion of the fastener 4 may be closed as the inflated portions 11*a* and 11*b* of the inflatable air chamber 11 overlap each other, while the inner wall of the inflatable air chamber 11 around the neck is brought into close contact with the neck with the inflation of the air chamber. Entry of water into the inside of the outer cloth 11 thus can be substantially perfectly prevented. When the fastener 4 is perfectly closed, the water-tightness of the neckband 2 can be further improved, so that entry of water through this portion can be perfectly prevented.

The hood A of this embodiment may be provided with an inflatable air chamber 21 to obtain the effect of the invention.

As shown in FIG. 4, the hood A which is provided separately of the outer cloth 1, can cover the head inclusive of the neckband 2 of the outer cloth 1 from the outside thereof, while it has an opening 2*a* to expose the eyes, nose and mouth. The inflatable air chamber 21 consists of a portion 21*a*, which is formed over the entire neckband 2*b* of the hood A, and a portion 21*b*, which is formed over a back portion of the hood, and it is provided with an air bomb 22.

With this construction of the hood A, by filling the inflatable air chamber portion 21*a* with air from the air bomb 22 with the hood A worn, the neckband 2 of the outer cloth 1 is urged from the outer side by the portion 21*a* that is inflated. Thus, an effect tending to prevent water from entering the inside of the outer cloth 1 through the neckband 2 can be obtained. Further, with the inflatable air chamber portion 21*b* over the back of the hood A filled with air, it provides together with the portion 21*a* around the neckband a buoyancy with respect to the head. This is very desirous in view of stably and safely supporting the head on the water surface after one has fallen into water. This effect may be promoted by providing the inner side of the edge of the opening 2*a* of the hood A with an inflatable air chamber 21*c*, which can be inwardly inflated.

The inflatable air chamber 11 or 21 may be provided on both or either one of the hood A and the coat portion B of the garment.

With the provision of the right side breast portion 11*c* of the inflatable air chamber on the inner side of the outer coat 11, the following effect can be obtained.

Figure 5:
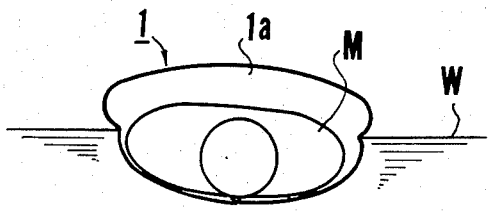
FIGS. 5(1)–5(4) show the function of the cold-proof water-proof garment according to the invention that is provided when a man wearing the garment comes to be floated with his or her front down on the water surface.
Figure 5:
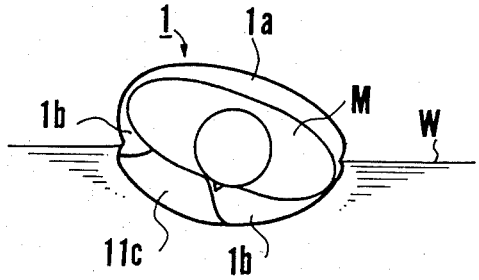
Figure 5:
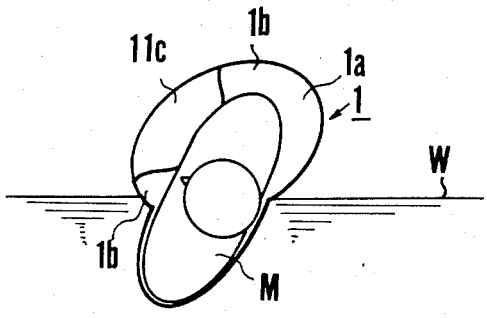
Figure 5:
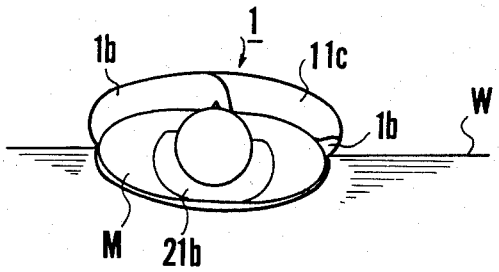

When a man with the cold-proof water-proof garment comes to float with his or her front down on the water surface W as shown in (1) in FIG. 5, most of the air inside the outer coat 1 is brought to be over the man M, forming an air layer 1*a* as is shown. Almost the entire air layer 1*a* that is formed inside the outer coat 1 is found above the water surface W, while the man M is found below the water surface W within the outer coat 1. Hitherto, it has often been the case that the man M clad with the cold-proof water-proof garment cannot turn back from this posture so that he or she is drowned to death. This occurs because the man M comes to float in a substantially horizontal posture on the water surface W due to considerable air present in the pants portion C and boots portion D of the outer cloth 1 and also the air layer 1*a* noted above is formed over the man M, so that it is very difficult for the man M to turn back or invert himself or herself on the water surface.

With the embodiment described above, after the man M clad therewith has fallen into water to float on the water surface in the posture as shown in (1) in FIG. 5, a posture as shown in (2) in FIG. 5 can be brought about. This is so because the right side breast portion 11*c* of the inflatable air chamber 11 (on the right side breast of the man) can be inflated inwardly of the upper cloth 1. To be more specific, as the right side breast portion 11*c* of the inflatable air chamber 11 is inflated inwardly of the outer cloth 1, the outer cloth 1 is pulled toward the inflated portion 11*c*. This reduces the volume of the air layer 1*a* on the back of the man M shown in (1) in FIG. 5. At the same time, the inflated portion 11*c* of the inflatable air chamber 11 on the front side of the man M and also an air layer 1*b* formed to surround the portion 11*c* now provide a buoyancy, generating a clockwise torque exerted to the man M. The man M thus can be rotated in the clockwise direction as shown in (3) in FIG. 5. As the man M is rotated, the buoyancy provided by the inflated portion 11*c* of the air chamber 11 and the surrounding air layer 1*b* is progressively increased, so that the man M can eventually assume a perfectly inverted posture as shown in (4) in FIG. 5.

It should be understood that the provision of the inflatable air chamber 11 on the inner side of either right or left side part of the front section of the coat portion of the outer coat, has an effect of reliably inverting a man floating with the cold-proof water-proof garment on the water surface from the posture with his or her front down to the posture with his or her front up in addition to the effect of blocking water-tight a portion of the garment communicating with the outside.

In the above embodiment, of the cold-proof water-proof garment, the hood A was provided separately of the coat portion B of the outer coat, but the invention is also applicable to a cold-proof water-proof garment, in which the hood A is united to the coat portion B of the garment.

Figure 2:
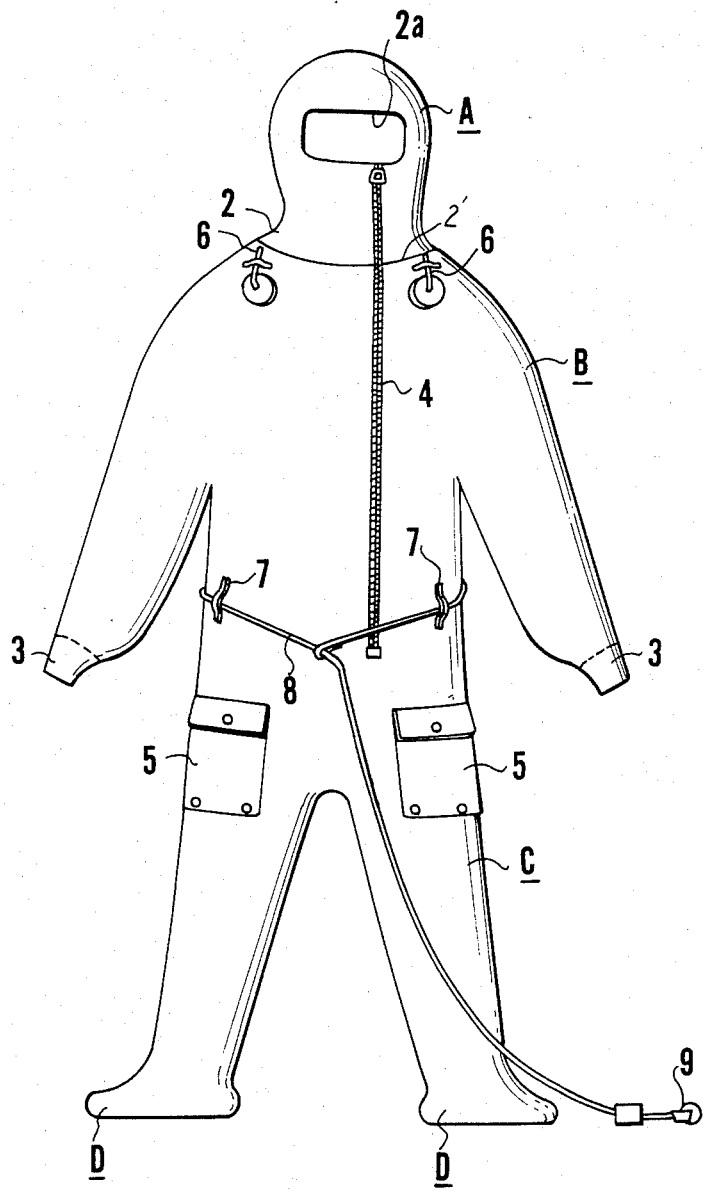
FIG. 2 is an elevational view showing a different prior art example of the cold-proof water-proof garment having a united hood.

The description will now be made with reference to FIGS. 2 and 6 to 8. In these Figures, like parts as those in FIGS. 1 and 3 to 5 are designated by like reference symbols. FIG. 2 shows a prior art cold-proof water-proof garment having a united hood. Referring to the Figure, a seam line 2' corresponds to a neckband, along which the hood A and coat portion B of the garment are united together. The prior art cold-proof water-proof garment of FIG. 2 has difficiencies similar to those of the prior art cold-proof water-proof garment of FIG. 1.

Figure 6:
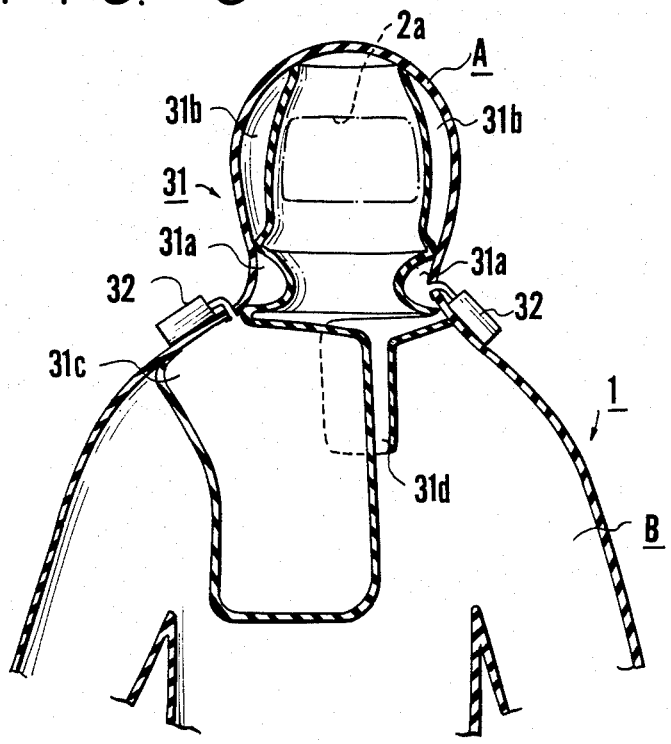
FIG. 6 is a gragmentary elevational sectional view showing a different embodiment of the cold-proof water-proof garment having a united hood according to the invention.
Figure 7:
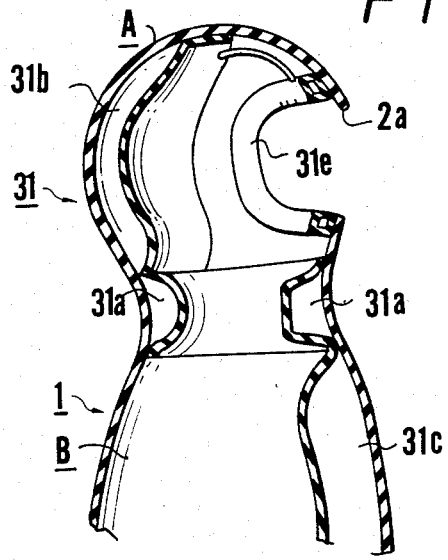
FIG. 7 is a side sectional view showing the united hood of the second embodiment.

FIGS. 6 and 7 show a second embodiment of the cold-proof water-proof garment according to the invention, which is improved over the prior art one shown in FIG. 2.

Referring to the Figures, reference numeral 31 designates an inflatable air chamber, which is made of a soft and tenacious sheet and is united to the inner side of the cuper coat 1. More particularly, the inflatable air chamber 31 includes a neck portion 31*a*, which is provided over the entire neckband 2, a rear head portion 31*b*, which is provided over a portion of the hood A centered on the rear head portion and communicating with the neck portion, and a right side breast portion 31*c*, which covers the right side shoulder and an upper portion of the right side breast and communicating with the neck portion 31*a* and rear head portion 31*b*. The individual portions 31*a* to 31*c* of the inflatable air chamber 31 may not be communicated with one another, but they may be formed as respective independent chambers or they may be defined as respective independent sections by partition members.

Reference numeral 32 designates an air bomb for supplying air to the inflatable air chamber 31. Where the individual portions 31*a* to 31*c* of the inflatable air chamber 31 are independent of one another, an air bomb is provided for each of the portions. The air bomb 32 is one which can be either manually or automatically operated to supply air to the inflatable air chamber 31 when required. The air bomb 32 may be replaced with other means for inflating the inflatable air chamber 31 inwardly of the outer cloth 1; for instance, it is possible to arrange such that air inhaled by a man wearing the garment is supplied to the inflatable air chamber 31.

Normally, the inflatable air chamber 31 is not filled with air, so that it is not obstructive when taking on the garment or when the garment is worn in a reluxed state with the fastener 4 not closed.

When a man wearing the above cold-proof water-proof garment in a reluxed state, i.e., with the fastener 4 imperfectly closed, or without the hood A worn on the head happens to fall into the sea, the inflatable air chamber 31 can be inflated by supplying air into it by opening the air bomb 32. At this time, all the portions 31*a* to 31*c* of the inflatable air chamber 31 are inflated inwardly of the outer cloth.1. If the fastener 4 is slightly open at this time, the open space is closed water-tight by overlapping portions 31*d* of the inflated neck and right side breast portions 31*a* and 31*c* to prevent entry of water into the inside of the outer cloth 1.

Further, with the inflation of the right side breast portion 31*c* of the inflatable air chamber 31, the same effects as described earlier in connection with the right side breast portion 11*c* in the previous embodiment can be obtained.

Figure 8:
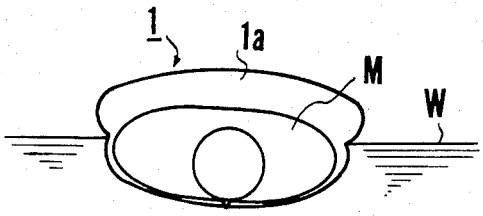
FIGS. 8(1)–8(4) show the function of a second embodiment of the cold-proof water-proof garment that is obtained when a man wearing the garment comes to be floated with his or her front down on the water surface.
Figure 8:
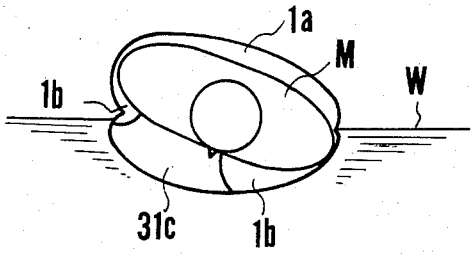
Figure 8:
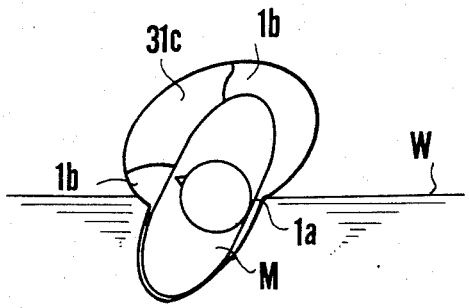
Figure 8:
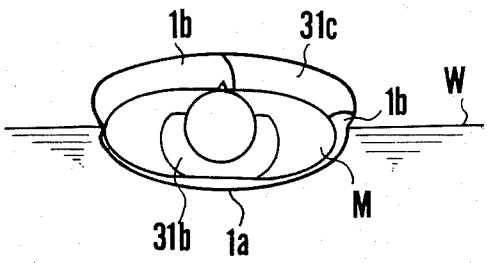

FIG. 8 shows the effect of this embodiment analogously to FIG. 5.

Aside from this, the rear head port-on 31*b* of the inflatable air chamber 31 provided on the hood A can co-operate with the neck and right side breast portions 31*a* and 31*c* of the chamber to increase the buoyancy of the upper half, i.e., the breast portion and portions thereabove, of the cold-proof water-proof garment when these portions are filled with air. Particularly, the rear head portion 31*b*, when filled with air, can support the head, so that the man having fallen into the sea can float on the water surface in a safe state with the head above the water surface. This posture is a very easy one to wait for the rescue.

Although there have been known life-saving dresses which are designed such that their upper half provides an increased buoyancy, the cold-proof water-proof garment according to the invention is quite set apart from those in the prior art in that the buoyancy of the upper half of the garment can be increased when necessary and that the garment is closed tight against water in the outside when the buoyancy is increased, i.e., when the inflatable air chamber 31 is filled with air.

While in the above embodiment of the cold-proof water-proof garment the inflatable air chamber 31 is provided on the outer cloth 1 over a back portion of the hood A, the neckband and a right side breast part of the coat portion, in order for the proper function of the cold-proof water-proof garment to be obtained even in such case as when the hood A is not worn or when the fastener 4 is not perfectly closed, the structure according to the invention as described before may be provided at least over the inner side of the neckband 2. Further, an inflatable air chamber 31*e* may be provided along the inner side of the edge of the opening 2*a* of the hood A such that it can be inflated inwardly of the hood A. This inflatable air chamber 31*e* is effective solely or in cooperation with the neck portion 31*a* of the inflatable air chamber 31 to prevent entry of water into the inside of the outer cloth 1.

As has been described in the foregoing, the cold-proof water-proof garment according to the invention is improved over the prior art one which has various problems in the actual use. For example, the prior art cold-proof water-proof garment must be worn in a predetermined perfect state in order to obtain all its proper functions, and this is sometimes undesired from the standpoint of the movability or ability of the man wearing it to do works. Further, if the garment is not fit in size to the man wearing it, entry of water into its inside cannot prevented perfectly even when it is worn in the perfect state. Furthermore in the event when the man clad with the garment without the hood property worn or without the fastener perfectly closed to provide for desired ability to do works falls into water, a great deal of water enters the inside of the outer cloth from the neckband so that the garment can no longer fulfill its proper role. With the cold-proof water-proof garment according to the invention, in which a buoyancy-providing chamber is provided on the inner side of the outer cloth over a portion thereof centered on the neckband such that it can be inflated inwardly of the outer cloth, it is possible, by filling the buoyancy-providing chamber with a gas providing the buoyancy, to realize substantially perfect water-tightness of the garment and increase the buoyancy of the upper half of the garment, particularly that which supports the head, irrespective of whether the garment is worn in a reluxed state desired for the ability of doing works or whether it is worn by a man not fit to its size. Further, the temperature insulating property can be enhanced. Thus, the cold-proof water-proof garment according to the invention can be worn in a state suitable to do work during the works and, in the event of accidental falling of the man wearing it into the sea, can reliably fulfill its proper functions, and thus it is very useful and beneficial in use.

What is claimed is:

1. A method of facilitating rotation of a man wearing a full body suit with fluid buoyancy from a face-down prone position to a face-up prone position comprising the steps of:

(a) providing a full body suit having a buoyancy chamber internally of the suit asymmetrical over the chest of the wearer;

(b) inflating the body suit with a buoyant fluid adequate to float the wearer in a prone position; and (c) inflating the buoyancy chamber (1) to provide asymetrical buoyancy within the body suit over the chest of the wearer and (2) to create additional space within the suit over the chest of the wearer asymmetrically for the buoyant fluid to collect to thus rotate the wearer from a face-down prone position to a position from which the wearer can complete the rotation to a face-up prone position.

2. Means for facilitating rotation of a man wearing a full body suit with fluid buoyancy from a face-down prone position to a face-up prone position comprising a full body suit having a first buoyancy chamber internally of the suit adequate to float the wearer in a prone position and a second buoyancy chamber internally of the suit asymmetrical over the chest of the wearer, whereby inflation of said second buoyancy chamber provides asymmetrical buoyancy within the body suit over the chest of the wearer to create additional space within the suit asymmetrically over the chest of the wearer for the buoyant fluid in said first chamber to collect to thus rotate the wearer from a face-down prone position to a position from which the wearer can complete the rotation to a face-up prone position.

3. A cold-proof water-proof garment with substantially water-proof wristbands and a selectively enlarged neck opening comprising:

an outer layer made of a relatively non-stretchable water-proof material;

an inner layer for temperature insulation and buoyancy, said inner layer including one of (a) a buoyant foam lining for said outer layer and (b) a temperature insulating inner suit separable from said outer layer to form a first buoyancy chamber between said layers; and a second buoyancy chamber carried by said outer layer internally thereof in the area of said neck opening and laterally asymmetrical with respect to the chest area, said second chamber being selectively inflatable inwardly of said outer layer to urge the internal surface of said second chamber toward the neck of the wearer to thereby provide a substantially water-proof seal around the neck of the wearer and to facilitate rotation of the wearer to a face-up position by creating additional space within the suit asymmetrically over the chest of the wearer for the buoyancy fluid to collect.

4. The garment of claim 3 wherein said garment includes a hood having a face opening and a third buoyancy chamber internally thereof in the rear of said hood so that inflation of said third buoyancy chamber provides additional buoyancy at the wearer's head and urges the hood backward on the head of the wearer to provide a substantially water-proof seal around the face of the wearer.

5. The garment of claim 4, wherein said second and third buoyancy chambers are in fluid communication.

6. The garment of claim 5 wherein said second chamber includes a band completely around said neck opening, said neck band being opened in the front of the garment at an angle to a radial to thereby provide overlapping flaps which are urged together by the inflation of said second chamber.

7. The garment of claim 6 wherein the front opening in said neck band extends downwardly in the front of said garment; and wherein said second chamber includes overlapping flaps which are urged together by the inflation of said second chamber.

8. The garment of claim 3 wherein said second chamber includes a neck band and a chest portion interrupted to form an opening in said neck band and in the front of the garment with overlapping flaps urged together to close the opening by the inflation of said second chamber.

9. The garment of claim 8 including a source of compressed fluid carried externally of said outer layer for inflating said second chamber.

10. The garment of claim 3 including a source of compressed fluid carried externally of said outer layer for inflating said second chamber.

* * * * *